US010234781B2

(12) United States Patent
Tsujihiro

(10) Patent No.: US 10,234,781 B2
(45) Date of Patent: Mar. 19, 2019

(54) ELECTROSTATIC LATENT IMAGE DEVELOPING TONER AND IMAGE FORMING APPARATUS

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/948,099

(22) Filed: Apr. 9, 2018

(65) Prior Publication Data

US 2018/0307150 A1 Oct. 25, 2018

(30) Foreign Application Priority Data

Apr. 20, 2017 (JP) ..... 2017-083518

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/093*** | (2006.01) |
| ***G03G 5/08*** | (2006.01) |
| *G03G 15/20* | (2006.01) |

(52) U.S. Cl.

CPC ..... *G03G 9/09716* (2013.01); *G03G 5/08* (2013.01); *G03G 9/0819* (2013.01); *G03G 9/0825* (2013.01); *G03G 9/08728* (2013.01); *G03G 9/08755* (2013.01); *G03G 9/09328* (2013.01); *G03G 9/09364* (2013.01); *G03G 9/09708* (2013.01); *G03G 9/09733* (2013.01); *G03G 15/2064* (2013.01); *G03G 2215/0607* (2013.01)

(58) Field of Classification Search

CPC ..... G03G 9/09708; G03G 9/09716; G03G 9/09733

USPC ..... 430/108.6

See application file for complete search history.

(56) References Cited

U.S. PATENT DOCUMENTS

| | | | | |
|---|---|---|---|---|
| 8,728,694 | B2 * | 5/2014 | Uemura | G03G 15/08 399/252 |
| 2014/0113226 | A1 * | 4/2014 | Ishii | G03G 9/09321 430/105 |
| 2018/0039196 | A1 * | 2/2018 | Owada | G03G 9/09725 |

FOREIGN PATENT DOCUMENTS

| | | |
|---|---|---|
| JP | 2009-098176 A | 5/2009 |

* cited by examiner

*Primary Examiner* — Janis L Dote

(74) *Attorney, Agent, or Firm* — Studebaker & Brackett PC

(57) ABSTRACT

An electrostatic latent image developing toner includes toner particles. Each of the toner particles includes a toner mother particle and an external additive. The toner mother particle contains a binder resin. The external additive includes external additive particles adhering to a surface of the toner mother particle. Each of the external additive particles includes a titanium oxide particle and resin particles adhering to a surface of the titanium oxide particle.

9 Claims, 2 Drawing Sheets

ELECTROSTATIC LATENT IMAGE DEVELOPING TONER AND IMAGE FORMING APPARATUS

INCORPORATION BY REFERENCE

The present application claims priority under 35 U.S.C. § 119 to Japanese Patent Application No. 2017-083518, filed on Apr. 20, 2017. The contents of this application are incorporated herein by reference in their entirety.

BACKGROUND

The present disclosure relates to an electrostatic latent image developing toner and an image forming apparatus.

In electrophotography, a surface of an electrophotographic photosensitive member (also referred to below simply as a photosensitive member) serving as an image bearing member is charged, and subsequently the photosensitive member is exposed to light, thereby forming an electrostatic latent image on the photosensitive member. Next, the electrostatic latent image is developed into a toner image using a developer, and the toner image is transferred to a recording medium. The toner image on the recording medium is then fixed using a fixing device including a pressing roller, for example, to form an image on the recording medium.

Ozone may be generated when a photosensitive member is charged in an image formation process by electrophotography. Such ozone may react with nitrogen in the air to form a nitrogen oxide (NOx), and the nitrogen oxide may react with moisture in the air to form a product (also referred to below as a charging product) such as nitric acid. The charging product may adhere to a surface of the photosensitive member. In such a situation, the photosensitive member decreases in surface electric resistance to disrupt latent-image charge on the photosensitive member. In a situation in which image formation is performed with such a photosensitive member in a high-humidity environment, image deletion (a phenomenon described as blurring of an image that looks as if the image was smeared) may occur. In particular, image deletion tends to easily occur in the case of a photosensitive member that includes an amorphous silicon-containing photosensitive layer in a surface portion thereof, because a surface of the photosensitive layer is relatively highly hydrophilic, and thus a charging product easily adheres to the surface of the photosensitive layer.

In order to cope with the image deletion, it has been contemplated to include titanium oxide particles having abrasive action as an external additive in an electrostatic latent image developing toner (also referred to below simply as a toner). A known technique for example inhibits occurrence of image deletion by causing titanium oxide particles added as an external additive to scratch off a charging product adhering to a surface of a photosensitive member.

SUMMARY

An electrostatic latent image developing toner according to an aspect of the present disclosure includes toner particles. Each of the toner particles includes a toner mother particle and an external additive. The toner mother particle contains a binder resin. The external additive includes external additive particles adhering to a surface of the toner mother particle. Each of the external additive particles includes a titanium oxide particle and resin particles adhering to a surface of the titanium oxide particle.

An image forming apparatus according to another aspect of the present disclosure includes an image bearing member, a developing device, a transfer device, and a fixing device. The developing device develops an electrostatic latent image on the image bearing member into a toner image with a developer. The developer contains the above-described electrostatic latent image developing toner. The transfer device transfers the toner image to a recording medium. The fixing device fixes the transferred toner image to the recording medium.

DETAILED DESCRIPTION

Figure 1:
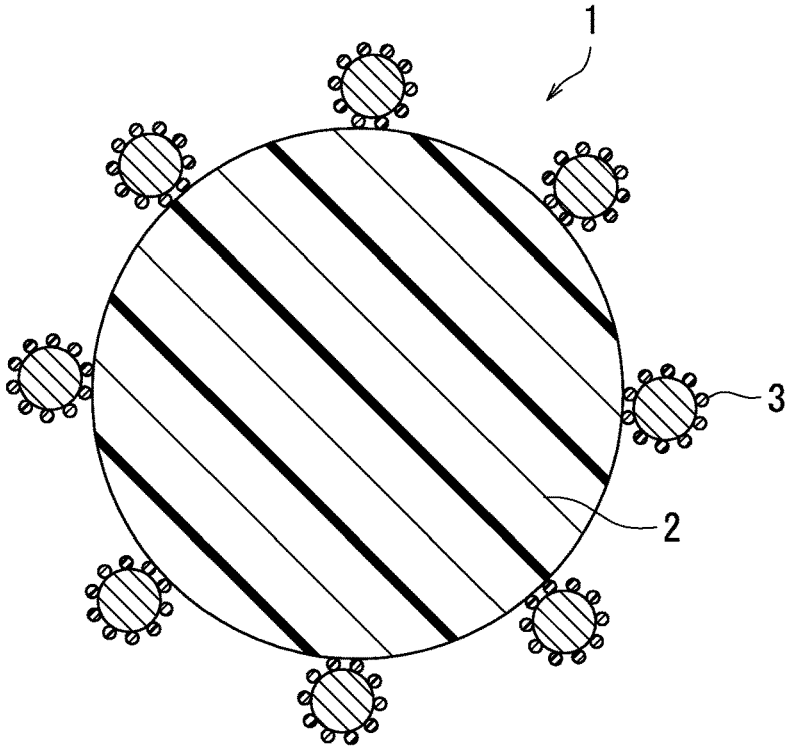
FIG. 1 is a cross-sectional view illustrating an example of a structure of a toner particle included in an electrostatic latent image developing toner according to a first embodiment of the present disclosure.

The following describes embodiments of the present disclosure. Evaluation results (values indicating shape and physical propertier a powder (specific examples include toner mother particles, external additive particles, titanium oxide particles, and resin particles) are each a number average of values measured for a suitable number of average particles selected from the particles included in the powder, unless otherwise stated. A value for volume median diameter ($D_{50}$) of a powder is measured using a laser diffraction/scattering particle size distribution analyzer ("LA-750", product of Horiba, Ltd.), unless otherwise stated. A number average particle diameter of a powder is a number average of equivalent circle diameters of primary particles of the powder (diameters of circles having the same area as projections of the primary particles) measured using a transmission electron microscope, unless otherwise stated. A number average particle diameter of a powder is for example a number average of equivalent circle diameters of 100 primary particles of the powder. The term chargeability refers to chargeability in triboelectric charging, unless otherwise stated. Strength of positive chargeability (or strength of negative chargeability) in triboelectric charging can be confirmed from for example a known triboelectric series. A toner as a measurement target can for example be triboelectrically charged by mixing and stirring the toner with a standard carrier (anionic standard carrier: N-01, cationic standard carrier: P-01) provided by The Imaging Society of Japan. Surface potential of the measurement target is measured before and after the triboelectric charging using for example a kelvin probe force microscope (KFM). A measurement target having a larger change in potential before and after the triboelectric charging has higher chargeability.

Acid and hydroxyl values are measured in accordance with "Japanese Industrial Standard (JIS) K0070-1992", unless otherwise stated. Values for number average molecular weight (Mn) and weight average molecular weight (Mw) are measured by gel permeation chromatography, unless otherwise stated. Values for a glass transition point (Tg) and a melting point (Mp) are measured using a differential scanning calorimeter ("DSC-6220", product of Seiko Instruments Inc.), unless otherwise stated. A value for a softening point (Tm) is measured using a capillary rheometer ("CFT-500D", product of Shimadzu Corporation), unless otherwise stated.

The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl. The term "(meth)acrylonitrile" may be used as a generic term for both acrylonitrile and methacrylonitrile. Note that a polyester resin with crystallinity is referred to as a "crystalline polyester resin". A non-crystalline polyester resin may be referred to below simply as a "polyester resin".

A radical polymer is obtained through radical polymerization of a monomer promoted by light irradiation or heat application in the presence of a polymerization initiator capable of generating radicals.

Titanium oxide particles may be surface-treated or not surface-treated. In a situation in which the entirety of the surface of a titanium oxide particle is covered with a treatment layer (for example, a conductive layer) and the surface is described as a "surface of a titanium oxide particle with resin particles adhering thereto", the surface refers to a surface of the treatment layer. In a situation in which a portion of the surface of a titanium oxide particle is covered with a treatment layer and the surface is described as a "surface of a titanium oxide particle with resin particles adhering thereto", the surface refers to both a surface of the treatment layer and an uncovered portion of the surface of the titanium oxide particle, which is a portion not covered with the treatment layer.

<First Embodiment: Toner>

A toner according to a first embodiment of the present disclosure is for example suitable for use as a positively chargeable toner for developing an electrostatic latent image. The toner according to the present embodiment is a powder including toner particles (particles each having the feature described below). The toner may be used as a one-component developer. Alternatively, a two-component developer may be prepared by mixing the toner and a carrier using a mixer (for example, a ball mill).

The toner according to the present embodiment includes toner particles. Each of the toner particles includes: a toner mother particle containing a binder resin; and an external additive including external additive particles adhering to a surface of the toner mother particle. The toner mother particles may contain, in addition to the binder resin, an optional internal additive (for example, at least one of a releasing agent, a colorant, a charge control agent, and a magnetic powder). Each of the external additive particles includes a titanium oxide particle and resin particles adhering to a surface of the titanium oxide particle. External additive particles each including a titanium oxide particle and resin particles adhering to a surface of the titanium oxide particle are also referred to below as resin-bearing titanium oxide particles.

Having the above-described feature, the toner according to the present embodiment can inhibit occurrence of an image defect due to whitening of a member of an image forming apparatus while also inhibiting occurrence of image deletion. The reason for the above is thought to be as follows.

The toner according to the present embodiment includes resin-bearing titanium oxide particles as external additive particles. The titanium oxide particles have abrasive action, allowing the toner to scratch off a charging product adhering to a surface of a photosensitive member. It is thought that through the above, the toner inhibits a reduction in surface electric resistance of the photosensitive member, and thus occurrence of image deletion is inhibited. Even when the resin-bearing titanium oxide particles are detached from the toner mother particles and reach a member such as a pressing roller, the surfaces of the resin particles can exhibit high smoothness to prevent the titanium oxide particles from adhering to the member. It is thought that through the above, occurrence of an image defect due to whitening of the member can be inhibited.

The toner particles included in the toner according to the present embodiment may be either toner particles each including no shell layer (referred to below as non-capsule toner particles) or toner particles each including a shell layer (referred to below as capsule toner particles). In each of the capsule toner particles, a toner mother particle includes a toner core containing a binder resin and a shell layer covering a surface of the toner core. The shell layer contains a resin. Both heat-resistant preservability and low-temperature fixability of the toner can be achieved for example by using low-melting toner cores and covering each toner core with a highly heat-resistant shell layer. An additive may be dispersed in the resin forming the shell layer. The shell layer may entirely cover the surface of each toner core or partially cover the surface of each toner core. The following toner mother particles of the non-capsule toner particles can be used as toner cores for capsule toner particles.

[Structure of Toner Particles]

Figure 2:
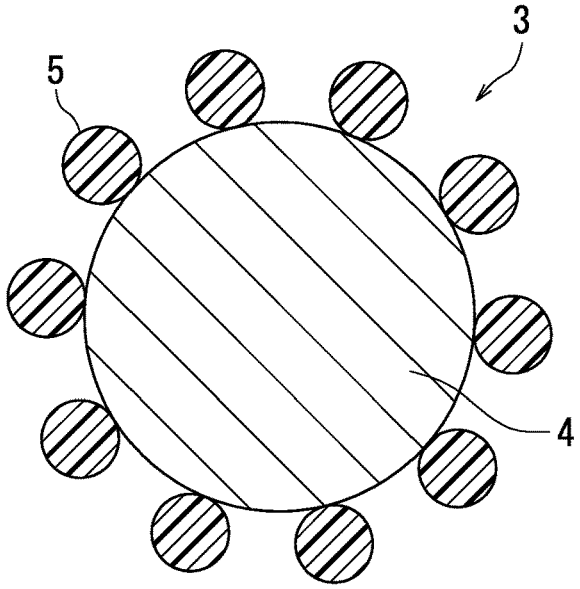
FIG. 2 is a cross-sectional view illustrating an example of a structure of an external additive particle included in the toner particle illustrated in FIG. 1.

The following describes a structure of the toner particles (particularly, external additive particles) included in the toner according to the present embodiment with reference to FIGS. 1 and 2. FIG. 1 is a cross-sectional view illustrating an example of the structure of a toner particle included in the toner according to the present embodiment. FIG. 2 is a cross-sectional view illustrating an example of the structure of an external additive particle (resin-bearing titanium oxide particle) included in the toner particle illustrated in FIG. 1.

A toner particle 1 illustrated in FIG. 1 includes a toner mother particle 2 and external additive particles 3 adhering to a surface of the toner mother particle 2. As illustrated in FIG. 2, the external additive particle 3 includes a titanium oxide particle 4 and resin particles 5 adhering to a surface of the titanium oxide particle 4. The number of the external additive particles 3 adhering to one toner mother particle 2 is not limited, although the cross-sectional view shown as FIG. 1 illustrates an example in which eight external additive particles 3 adhere to one toner mother particle 2. Likewise, the number of the resin particles 5 adhering to one titanium oxide particle 4 is not limited, although the cross-sectional view shown as FIG. 2 illustrates an example in which ten resin particles 5 adhere to one titanium oxide particle 4.

In order to further inhibit occurrence of an image defect due to whitening of a member by effectively preventing the external additive particles 3 from adhering to the member, the resin particles 5 preferably function as particles slidable between the titanium oxide particles 4 and the member without being firmly bonded to the titanium oxide particles 4. In order that the resin particles 5 have such a function, the resin particles 5 preferably adhere to titanium oxide particles 4 by Van der Waals force.

In order to further inhibit occurrence of an image defect due to whitening of a member, a proportion of the area of a resin particle-covered region out of the surface of each resin-bearing titanium oxide particle 4 is preferably at least 1%, and more preferably at least 3% (also referred to below as a coverage ratio). The resin particle-covered region is a region covered with the resin particles 5. At the same time, in order to further inhibit occurrence of image deletion, the coverage ratio is preferably no greater than 50%, more preferably no greater than 40%, and still more preferably no greater than 30%. The coverage ratio is measured according to the same method as a method employed in the Examples explained further below or according to an alternative thereof.

(Titanium Oxide Particles)

No particular limitations are placed on the shape of the titanium oxide particles 4, and the titanium oxide particles 4 may be spherical or irregular-shaped (non-spherical). The titanium oxide particles 4 may be surface-treated. The titanium oxide particles 4 may each have a treatment layer formed through a surface treatment. For example, at least a portion of the surface of each titanium oxide particle 4 may be covered with a conductive layer (such titanium oxide particles are also referred to below as conductive titanium oxide particles). Chargeability of the toner can be adjusted to within an appropriate range through at least a portion of the surface of each titanium oxide particle being covered with a conductive layer. The conductive titanium oxide particles tend to have low surface smoothness, and therefore easily adhere to a member such as a pressing roller. Therefore, the use of the conductive titanium oxide particles as the external additive particles typically leads to occurrence of an image defect due to whitening of a member. However, according to the present embodiment, it is possible to inhibit occurrence of an image defect due to whitening of a member even if the conductive titanium oxide particles are used as the titanium oxide particles 4. The reason for the above is thought to be that the resin particles 5 adhering to the surfaces of the titanium oxide particles 4 can exhibit high smoothness to prevent the external additive particles 3 from adhering to the member as described above.

The following describes an example of a method for covering at least a portion of the surface of each titanium oxide particle with a conductive layer. First, titanium oxide particles are dispersed in water to prepare a suspension of the titanium oxide particles. Next, the suspension is heated, and an aqueous sodium hydroxide solution and a solution of tin (IV) chloride pentahydrate ($SnCl_4.5H_2O$) and antimony chloride ($SbCl_2$) in an aqueous hydrochloric acid solution are added to the heated suspension. During this process, the suspension is maintained at pH 2 to 3. Through the above, a conductive layer containing hydrates of tin oxide and antimony oxide is formed on the surface of each titanium oxide particle in the suspension. The titanium oxide particles that are used in the preparation of the suspension may for example be particles obtained by pulverizing a bulk of titanium oxide produced according to a known method or commercially available titanium oxide particles. Alternatively, commercially available conductive titanium oxide particles may be used.

In order to further inhibit occurrence of image deletion, the titanium oxide particles 4 preferably have a volume median diameter ($D_{50}$) of at least 0.01 μm, more preferably at least 0.05 μm, and still more preferably at least 0.1 μm. At the same time, in order to inhibit excessive abrasion of the surface of the photosensitive member, the titanium oxide particles 4 preferably have a volume median diameter ($D_{50}$) of no greater than 5 μm, more preferably no greater than 3 μm, and still more preferably no greater than 1 μm.

(Resin Particles)

No particular limitations are placed on the shape of the resin particles 5, and the resin particles 5 may be spherical or irregular-shaped. In order to further inhibit occurrence of an image defect due to whitening of a member, however, the resin particles 5 are preferably spherical.

In order to further inhibit occurrence of an image defect due to whitening of a member, the resin particles 5 preferably have a roundness of at least 0.830, and more preferably at least 0.850. No particular limitations are placed on the upper limit of the roundness of the resin particles 5. In order to reduce the manufacturing cost of the resin particles 5, the resin particles 5 preferably have a roundness of no greater than 0.999. The roundness of the resin particles 5 can for example be controlled by adjusting the amount of a cross-linking agent described below that is added in synthesis of a resin for forming the resin particles 5. The roundness of the resin particles 5 tends to increase with a decrease in the amount of the cross-linking agent. The roundness is measured according to the same method as a method employed in the Examples explained further below or according to an alternative thereof.

In order to further inhibit occurrence of an image defect due to whitening of a member, the resin particles 5 preferably have a number average particle diameter of at least 10 nm, and more preferably at least 50 nm. At the same time, in order to further inhibit occurrence of image deletion, the resin particles 5 preferably have a number average particle diameter of no greater than 1,000 nm, and more preferably no greater than 500 nm. In order to further inhibit occurrence of an image defect due to whitening of a member with the use of the titanium oxide particles 4 having a volume median diameter ($D_{50}$) of at least 0.1 μm and no greater than 1 μm, it is particularly preferable that the resin particles 5 have a number average particle diameter of at least 50 nm and no greater than 500 nm.

No particular limitations are placed on the resin for forming the resin particles 5 so long as the resin can adhere to the surfaces of the titanium oxide particles 4. In order to further inhibit occurrence of an image defect due to whitening of a member, the resin is preferably a radical polymer.

Examples of monomers that can be used for formation of a radical polymer (also referred to below as radical polymerizable monomers) include styrene-based monomers such as styrene, o-methylstyrene, m-methylstyrene, p-methylstyrene, p-phenylstyrene, p-ethylstyrene, 2,4-dimethylstyrene, p-t-butylstvrene, p-n-hexylstyrene, p-n-octylstyrene, p-n-nonylstyrene, p-n-decylstyrene, and p-n-dodecylstyrene; (meth)acrylic acid ester-based monomers such as methyl (meth)acrylate, ethyl (meth)acrylate, n-propyl (meth)acrylate, iso-propyl (meth)acrylate, n-butyl (meth)acrylate, isobutyl (meth)acrylate, t-butyl (meth)acrylate, n-octyl (meth)acrylate, 2-ethylhexyl (meth)acrylate, stearyl (meth) acrylate, lauryl (meth)acrylate, and phenyl (meth)acrylate; vinyl ester-based monomers such as vinyl acetate and vinyl propionate; vinyl ether-based monomers such as vinyl methyl ether and vinyl ethyl ether; vinyl ketone-based monomers such as vinyl methyl ketone, vinyl ethyl ketone, and vinyl hexyl ketone; (meth)acrylic acid; and (meth) acrylonitrile. In particular, in order to further inhibit occurrence of an image defect due to whitening of a member, styrene-based monomers and (met)acrylic acid ester-based monomers are preferable, styrene-based monomers are more preferable, and styrene is still more preferable. As the radical polymer, a homopolymer obtained through polymerization of one of the radical polymerizable monomers may be used, or a copolymer obtained through copolymerization of two or more of the radical polymerizable monomers may be used.

No particular limitations are placed on the synthesis method of the resin particles 5, and the resin particles 5 can for example be synthesized by a known polymerization method. Examples of polymerization methods that can be used include suspension polymerization, emulsion polymerization, and solution polymerization. In order to control the roundness of the resin particles 5 within the above-specified preferable range, emulsion polymerization is preferable. The resin particles 5 containing a radical polymer can for example be synthesized through radical polymerization of a radical polymerizable monomer in the presence of a polymerization initiator. Examples of polymerization initiators that can be used include azo polymerization initiators such as azobisisobutyronitrile, peroxide-based polymerization initiators such as benzoyl peroxide, and persulfate-based polymerization initiators such as potassium persulfate. Commercially available resin particles may be used as the resin particles 5 of the present embodiment.

In the case of the resin particles 5 containing a radical polymer, the resin particles 5 may be composed only of the radical polymer or may be composed of a resin obtained by mixing the radical polymer and another resin (for example, a resin obtained through polycondensation). Alternatively, the resin particles 5 may be composed of different radical polymers.

In order to further inhibit occurrence of an image defect due to whitening of a member, the resin particles 5 preferably have a cross-linking structure. A cross-linking structure can for example be formed by synthesizing the resin forming the resin particles 5 through polymerization of different monomers including a cross-linking agent. In the case of the resin particles 5 containing a radical polymer, for example, the resin particles 5 having a cross-linking structure can be obtained through copolymerization of at least one of the radical polymerizable monomers (monofunctional radical polymerizable monomers) listed above and a polyfunctional radical polymerizable monomer serving as a cross-linking agent.

Examples of preferable polyfunctional radical polymerizable monomers include a monomer having a plurality of carbon-to-carbon double bonds "C═C". Examples of such monomers include aliphatic diene-based monomers such as isoprene, 1,3-butadiene, 3-methyl-1,2-butadiene, 2,3-dimethyl-1,3-butadiene, pentadiene, hexadiene, and octadiene; alicyclic diene-based monomers such as cyclopentadiene, cyclohexadiene, and cyclooctadiene; aromatic divinyl-based monomers such as divinylbenzene (specific examples include o-divinylbenzene, m-divinylbenzene, and p-divinylbenzene), divinyltoluene, divinylxylene, divinylbiphenyl, and divinylnaphthalene; and di(meth)acrylic acid-based monomers such as ethylene di(meth)acrylate and 1,6-hexylene di(meth)acrylate. In particular, in order to further inhibit occurrence of an image defect due to whitening of a member, the polyfunctional radical polymerizable monomer is preferably an aromatic divinyl-based monomer, and more preferably divinylbenzene.

In the case of copolymerization of a monofunctional radical polymerizable monomer and a polyfunctional radical polymerizable monomer, it is preferable to cause at least 0.05 mol and no greater than 1 mol of the polyfunctional radical polymerizable monomer to react with 1 mol of the monofunctional radical polymerizable monomer, and it is more preferable to cause at least 0.05 mol and no greater than 0.5 mol of the polyfunctional radical polymerizable monomer to react with 1 mol of the monofunctional radical polymerizable monomer, in order to further inhibit occurrence of an image defect due to whitening of a member.

Whether or not the resin particles 5 have a cross-linking structure can be determined according to solubility thereof in a solvent. The solvent to use for the determination can be selected as appropriate depending on the resin forming the resin particles 5. For example, in the case of the resin particles 5 formed from a styrene-based resin, whether or not the resin particles 5 have a cross-linking structure can be determined according to solubility thereof in an aprotic polar solvent such as tetrahydrofuran. In the case of the resin particles 5 formed from polystyrene, which is a homopolymer of styrene, for example at least 75% by mass of the resin particles 5 dissolve in the aprotic polar solvent. In the case of the resin particles 5 formed from a copolymer of styrene and a polyfunctional radical polymerizable monomer, at least a portion of the resin particles 5 is cross-linked, and therefore for example at least 25% by mass of the resin particles 5 do not dissolve in the aprotic polar solvent.

The resin particles 5 having a cross-linking structure preferably have a gel fraction of at least 30% and no greater than 90%, and more preferably at least 40% and no greater than 85%, in order to further inhibit occurrence of an image defect due to whitening of a member. The gel fraction is measured according to the same method as a method employed in the Examples explained further below or according to an alternative thereof.

[Composition of Non-capsule Toner Particles]

The following describes a composition of the non-capsule toner particles. Specifically, the following describes toner mother particles (a binder resin and an internal additive) and an external additive in the stated order.

[Toner Mother Particles]

The toner mother particles contain a binder resin. The toner mother particles may contain an internal additive (for example, at least one of a colorant, a releasing agent, a charge control agent, and a magnetic powder). In order to obtain a toner suitable for image formation, the toner mother particles preferably have a volume median diameter ($D_{50}$) of at least 4 μm and no greater than 9 μm.

(Binder Resin)

The binder resin is typically a main component (for example, at least 85% by mass) of the toner mother particles. Accordingly, properties of the binder resin are thought to have a great influence on overall properties of the toner mother particles. Properties (specific examples include hydroxyl value, acid value, Tg, and Tm) of the binder resin can be adjusted by using different resins in combination for the binder resin. The toner mother particles have a higher tendency to be anionic in a situation in which the binder resin has an ester group, a hydroxyl group, an ether group, an acid group, or a methyl group, and have a higher tendency to be cationic in a situation in which the binder resin has an amino group or an amide group.

In order to improve low-temperature fixability of the toner, the toner mother particles preferably contain a thermoplastic resin as the binder resin, and more preferably contain a thermoplastic resin as the binder resin in an amount of at least 85% by mass relative to the total amount of the binder resin. Examples of thermoplastic resins that can be contained in the toner mother particles include styrene-based resins, (meth)acrylic acid-based resins (specific examples include (meth)acrylic acid ester polymers), olefin-based resins (specific examples include polyethylene resins and polypropylene resins), vinyl resins (specific examples include vinyl chloride resins, polyvinyl alcohol, vinyl ether resins, and N-vinyl resins), polyester resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be used as the binder resin of the toner mother particles.

In order to improve low-temperature fixability of the toner, the toner mother particles preferably contain a polyester resin as the binder resin. The toner mother particles may contain a crystalline polyester resin as the binder resin.

A thermoplastic resin can be obtained through addition polymerization, copolymerization, or polycondensation of at least one thermoplastic monomer. The thermoplastic monomer is a monomer that forms a thermoplastic resin through homopolymerization (specific examples include a (meth) acrylic acid ester-based monomer and a styrene-based monomer) or a monomer that forms a thermoplastic resin through polycondensation (for example, a combination of a polyhydric alcohol and a polycarboxylic acid that forms a polyester resin through polycondensation).

A polyester resin can be synthesized through polycondensation of at least one polyhydric alcohol with at least one polycarboxylic acid. Examples of alcohols that can be used in synthesis of the polyester resin include dihydric alcohols (specific examples include diols and bisphenols) and tri- or higher-hydric alcohols listed below. Examples of carboxylic acids that can be used in synthesis of the polyester resin include di-, tri-, and higher-basic carboxylic acids listed below. Note that instead of a polycarboxylic acid, an anhydride of the polycarboxylic acid may be used.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxy methylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

In a situation in which the toner mother particles are prepared by a pulverization method described below, the binder resin preferably includes a non-crystalline polyester resin and a crystalline polyester resin having a repeating unit X derived from a (meth)acrylic acid ester-based monomer and a repeating unit Y derived from a styrene-based monomer. It is thought that as a result of the crystalline polyester resin having the repeating units X and Y, the crystalline polyester resin and the non-crystalline polyester resin are less compatible to provide more interfaces in a melt-kneading step of the pulverization method. Thus, the melt-kneaded product tends to exhibit improved pulverizability. According to an example of a method for introducing the repeating units X and Y into the crystalline polyester resin, first, a crystalline polyester resin is synthesized through polycondensation using a monomer having a carbon-to-carbon double bond as at least one of a polyhydric alcohol and a polycarboxylic acid. Next, addition polymerization of the crystalline polyester resin obtained as described above with a (meth)acrylic acid ester-based monomer and a styrene-based monomer is caused to yield a crystalline polyester resin having the repeating units X and Y.

Examples of polyhydric alcohols having a carbon-to-carbon double bond that can be used include 2-butene-1,4-diol and 2-pentene-1,5-diol. Examples of polycarboxylic acids having a carbon-to-carbon double bond that can be used include maleic acid and fumaric acid. The same (meth) acrylic acid ester-based monomers and styrene-based monomers as those listed above as examples of radical polymerizable monomers for formation of the resin particles 5 can be used for preparation of the toner mother particles.

(Colorant)

The toner mother particles may contain a colorant. A known pigment or dye matching a color of the toner can be used as a colorant. In order to achieve high quality image formation using the toner, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may contain a non-black colorant. The non-black colorant is for example a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner mother particles may contain a releasing agent. The releasing agent is for example used in order to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; ester waxes having a fatty acid ester as a main component such as montanic acid ester wax and castor wax; and waxes in which a fatty acid ester is partially or fully deoxidized such as deoxidized carnauba wax. In the present embodiment, one releasing agent may be used independently, or two or more releasing agents may be used in combination.

In a situation in which the binder resin is a polyester resin, the releasing agent is preferably carnauba wax, ester wax, or polyethylene wax. In a situation in which the binder resin is a styrene-based resin or a copolymer thereof, the releasing agent is preferably paraffin wax or Fischer-Tropsch wax. In order to improve compatibility between the binder resin and the releasing agent, a compatibilizer may be added to the toner mother particles.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent. The cationic strength of the toner mother particles can be increased through the toner mother particles containing a positively chargeable charge control agent. However, when sufficient toner chargeability is ensured, the toner mother particles do not need to contain a charge control agent.

(Magnetic Powder)

The toner mother particles may contain a magnetic powder. Examples of materials of the magnetic powder that can be used include ferromagnetic metals (specific examples include iron, cobalt, and nickel), alloys of ferromagnetic metals, ferromagnetic metal oxides (specific examples include ferrite, magnetite, and chromium dioxide), and materials subjected to ferromagnetization (specific examples include thermal treatment). In the present embodiment, one magnetic powder may be used independently, or two or more magnetic powders may be used in combination.

[Toner Mother Particle Preparation Method]

Examples of preferable methods for preparing the toner mother particles include a pulverization method and an aggregation method. These methods facilitate sufficient dispersion of internal additives in the binder resin.

In one example of the pulverization method, the binder resin, the colorant, the charge control agent, and the releasing agent are first mixed together. Next, the resultant mixture is melt-kneaded using a melt-kneader (for example, a single or twin screw extruder). The resultant melt-kneaded product is subsequently pulverized and classified. The above process yields toner mother particles.

In one example of the aggregation method, fine particles of the binder resin, the releasing agent, and the colorant are first caused to aggregate in an aqueous medium until particles of a desired diameter are obtained. Through the above, aggregated particles containing the binder resin, the releasing agent, and the colorant are formed. Next, the resultant aggregated particles are heated in order to cause components contained in the aggregated particles to coalesce. The above process yields toner mother particles having a desired particle diameter.

[External Additive]

The toner particles included in the toner according to the present embodiment include an external additive having the above-described resin-bearing titanium oxide particles.

In order to improve properties such as fluidity of the toner, the toner particles preferably further include at least one type of optional external additive particles that is different from the resin-bearing titanium oxide particles as an external additive. Examples of optional external additives that can be used include silica particles and particles of a metal oxide (specific examples include alumina, magnesium oxide, zinc oxide, strontium titanate, and barium titanate). The toner particles according to the present embodiment may include two or more types of optional external additive particles. In order to improve fluidity of the toner, it is preferable to use silica particles as the optional external additive particles.

Alternatively or additionally, the toner particles may include titanium oxide particles with no resin particles adhering thereto (also referred to below as resin-free titanium oxide particles) as the optional external additive particles. In such a situation, in order to further inhibit occurrence of an image defect due to whitening of a member, the resin-bearing titanium oxide particles are preferably contained in an amount of at least 50% by mass relative to total mass of the resin-bearing titanium oxide particles and the resin-free titanium oxide particles, more preferably in an amount of at least 70% by mass, and still more preferably at least 90% by mass.

In order to improve fluidity or handleability of the toner, the amount of the external additive particles (in a situation in which different types of external additive particles are used, the total amount of the external additive particles) is preferably at least 0.5 parts by mass and no greater than 10 parts by mass relative to 100 parts by mass of the toner mother particles. In order to further inhibit occurrence of an image defect due to whitening of a member while also inhibiting occurrence of image deletion, the resin-bearing titanium oxide particles preferably account for at least 20% by mass of the total amount of the external additive particles. In order to obtain a toner having excellent fluidity, silica particles preferably account for at least 20% by mass of the total amount of the external additive particles.

[Composition of Capsule Toner Particles]

The following describes a composition of the capsule toner particles. The above-described toner mother particles for the non-capsule toner particles can for example be used as toner cores of the capsule toner particles. The description of the external additives given above with respect to the non-capsule toner particles applies equally to the capsule toner particles. The following therefore describes shell layers of the capsule toner particles.

(Shell Layer)

The shell layers may be grainy or non-grainy films. Fine resin particles may be used as a material for forming the shell layers. It is thought that non-grainy films are formed as the shell layers in a situation in which the material (fine resin particles) is caused to completely melt and hardened into a film form. On the other hand, it is thought that films each formed from rows of two-dimensionally arranged fine resin particles (grainy films) are formed as the shell layers in a situation in which the material (fine resin particles) is caused not to completely melt and hardened into a film form. Each of the shell layers is not necessarily a continuous layer. Each of the shell layers may be one film, may be a collection of a plurality of spaced-apart films (islands), or may include both the fine resin particles and the resin film.

The shell layers may be substantially composed of a thermosetting resin, may be substantially composed of a thermoplastic resin, or may contain both a thermosetting resin and a thermoplastic resin. In a situation in which the shell layers contain both a thermosetting resin and a thermoplastic resin, the ratio between the thermoplastic resin and the thermosetting resin in the shell layers is determined as appropriate.

In order to improve heat-resistant preservability of the toner, the shell layers preferably contain a thermosetting resin. Particularly preferably, in order to improve charge stability and heat-resistant preservability of the toner, the shell layers contain at least one thermosetting resin selected from the group consisting of melamine-based resins, urea-based resins, and glyoxal-based resins.

In order to readily adjust chargeability of the shell layers (and thus to adjust chargeability of the toner mother particles), it is preferable to include in the shell layers at least two resins that are different in chargeability. In particular, in a situation in which the shell layers contain a first resin and a second resin having higher positive chargeability than the first resin, the first resin is preferably of stronger hydrophobic character than the second resin. In such a situation, the highly hydrophobic first resin inhibits adsorption of moisture on the surfaces of the toner particles, and thus the toner tends to exhibit improved charge stability in a high temperature and high humidity environment. The following describes a situation in which the shell layers contain the first resin and the second resin having higher positive chargeability than the first resin, and the first resin is of stronger hydrophobic character than the second resin. The first resin is referred to as a hydrophobic resin, and the second resin is referred to as a positively chargeable resin.

In order that the shell layers have suitable strength, the positively chargeable resin and the hydrophobic resin preferably include a repeating unit derived from a common monomer. The repeating unit derived from the common monomer locally increases strength of bonding between the positively chargeable resin and the hydrophobic resin. The common monomer refers to one species of monomer common to the positively chargeable resin and the hydrophobic resin. The species of a monomer is for example identified according to a CAS registry number. One species of monomer can be represented by one chemical formula. In a situation in which both the positively chargeable resin and the hydrophobic resin include a repeating unit derived from n-butyl acrylate, for example, it means that the positively chargeable resin and the hydrophobic resin include the repeating unit derived from the common monomer (n-butyl acrylate).

The hydrophobic resin is for example a resin having a repeating unit derived from at least one styrene-based monomer. In order that the shell layers have a sufficiently strong hydrophobic character and suitable strength, the hydrophobic resin is preferably a copolymer of at least one styrene-based monomer and at least one (meth)acrylic acid ester-based monomer.

In order that the shell layers have a sufficiently strong hydrophobic character and suitable strength, it is preferable that a repeating unit derived from a styrene-based monomer has the highest mole fraction among all the repeating units included in the hydrophobic resin.

In order to sufficiently inhibit adsorption of moisture in the air on the surfaces of the toner particles, the proportion of a repeating unit having a hydrophilic functional group is preferably no greater than 10% by mass among all the repeating units included in the hydrophobic resin. Particularly preferably, the proportion is 0% by mass (the hydrophobic resin includes no repeating unit having a hydrophilic functional group).

The positively chargeable resin is preferably a resin including at least one repeating unit derived from a nitrogen-free vinyl compound and at least one repeating unit derived from a nitrogen-containing vinyl compound (specific examples include quaternary ammonium compounds and pyridine compounds). The vinyl compound is a compound having a vinyl group ($CH_2$═CH—) or a substituted vinyl group in which hydrogen is replaced (specific examples include ethylene, propylene, butadiene, vinyl chloride, (meth)acrylic acid, methyl (meth)acrylate, (meth)acrylonitrile, and styrene). The vinyl compound can be formed into a polymer (resin) by addition polymerization through carbon-to-carbon double bonds "C═C" each included in the vinyl group or the substituted vinyl group.

In order that the shell layers have sufficiently strong positive chargeability, the positively chargeable resin preferably includes a repeating unit derived from a quaternary ammonium compound as the repeating unit derived from a nitrogen-containing vinyl compound.

In order that the shell layers have sufficiently strong positive chargeability and suitable strength, the positively chargeable resin is preferably a copolymer of at least one quaternary ammonium compound and at least one (meth) acrylic acid ester.

In order to improve positive chargeability of the toner, the shell layers preferably include particles of the positively chargeable resin (particles that are substantially composed of the positively chargeable resin). In a situation in which the shell layers include the particles of the positively chargeable resin, the toner particles are positively charged by friction with a carrier easily.

In order that the toner particles are positively chargeable, the shell layers preferably include a positively chargeable charge control agent. Examples of preferable positively chargeable charge control agents are listed below. Note that a derivative or a salt of any of the compounds listed below may be used as necessary.

Examples of positively chargeable charge control agents that can be used include azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; metal salts of naphthenic acids; metal salts of higher organic carboxylic acids; alkoxylated amines; alkylamides; and quaternary ammonium salts such as benzyldecylhexylmethyl ammonium chloride, decyltrimethyl ammonium chloride, 2-(methacryloyloxy) ethyltrimethylammonium chloride, and dimethylaminopropyl acrylamide methyl chloride quaternary salt.

(Shell Layer Formation Method)

The following describes an example of a shell layer formation method. First, an aqueous medium (for example, ion exchanged water) is prepared in which materials for forming the shell layers (shell materials) and the toner cores can be dissolved or dispersed. Next, for example hydrochloric acid is used to adjust the aqueous medium to a specific pH (for example, a pH selected from a range of from 3 to 5). Next, the toner cores and the shell materials are added into the pH adjusted aqueous medium. The shell materials are for example a suspension of the hydrophobic resin (a liquid containing fine particles of the hydrophobic resin) and a suspension of the positively chargeable resin (a liquid containing fine particles of the positively chargeable resin). The shell materials may include a component for synthesis of a thermosetting resin.

The aforementioned materials including the shell materials may be added to the aqueous medium at room temperature (approximately 25° C.) or may be added to the aqueous medium adjusted to a specific temperature. An appropriate amount of each shell material can be calculated based on the specific surface area of the toner cores. A polymerization accelerator may be added to the aqueous medium in addition to the shell materials.

In order that the shell materials adhere to the surfaces of the toner cores in a uniform manner, a high degree of dispersion of the toner cores is preferably achieved in the liquid containing the shell materials. In order to achieve a high degree of dispersion of the toner cores in the liquid, a surfactant may be added to the liquid, or the liquid may be stirred using a powerful stirrer (for example, "Hivis Disper Mix", product of PRIMIX Corporation). In a situation in which the toner cores are anionic, aggregation of the toner cores can be inhibited by using an anionic surfactant having the same polarity. Examples of surfactants that can be used include sulfate ester salt surfactants, sulfonic acid salt surfactants, phosphate acid ester salt surfactants, and soaps.

Next, the liquid containing the aforementioned materials including the shell materials is heated under stirring up to a target temperature (for example, a temperature selected from a range of from 45° C. to 85° C.) at a specific heating rate (for example, a rate selected from a range of from 0.1° C./minute to 3° C./minute). Furthermore, the liquid is maintained at the target temperature under stirring for a specific period of time (for example, a period of time selected from a range of from 30 minutes to 4 hours). It is thought that a reaction between the toner cores and the shell materials (fixation of the shell layers) proceeds while the liquid is maintained at the high temperature (or while the liquid is being heated). Either or both of the fine particles of the hydrophobic resin and the fine particles of the positively chargeable resin can be prevented from melting and maintained as particles, or can be caused to melt and hardened into a film form by adjusting the target temperature, Tg of the hydrophobic resin, and Tg of the positively chargeable resin. In a situation in which only the fine particles of the hydrophobic resin, among the fine particles of the hydrophobic resin and the fine particles of the positively chargeable resin, are caused to melt, for example, it is thought that the melted fine particles of the hydrophobic resin come in contact with one another and join together to form the films. Meanwhile, it is thought that the unmelted fine particles of the positively chargeable resin are maintained as particles and are present on the surfaces of the toner cores. Through the above, a shell layer including a plurality of fine particles of the positively chargeable resin and a film of the hydrophobic resin present between the particles can be formed on the surface of each toner core.

The roundness of the toner mother particles can be adjusted by adjusting at least one of the target temperature and the period of time of maintaining at the target temperature. In order to prevent elution of the toner core materials or transformation of the toner cores in shape, the target temperature is preferably lower than Tg of the toner cores. However, the toner cores may be purposely caused to transform in shape by setting the target temperature to a temperature equal to or higher than Tg of the toner cores. The toner cores transform in shape more readily with increasing target temperature, thereby tending to yield toner mother particles that are more spherical. Preferably, the target temperature is adjusted so that the toner mother particles have a desired shape. The shell layers tend to be hard as a result of the shell materials being caused to react at a high temperature.

After the shell layers are formed as described above, the dispersion of the toner mother particles is neutralized using for example sodium hydroxide. Next, the dispersion of the toner mother particles is cooled to for example room temperature (approximately 25° C.). Next, the dispersion of the toner mother particles is filtered using for example a Buchner funnel. Through the above, the toner mother particles are separated from the liquid (solid-liquid separation), and thus a wet cake of the toner mother particles is obtained. Subsequently, the resultant wet cake of the toner mother particles is washed. Subsequently, the washed toner mother particles are dried. The above process yields toner mother particles for the capsule toner particles.

<Second Embodiment: Toner Production Method>

The following describes a toner production method according to a second embodiment of the present disclosure. Description of the same components as those of the toner according to the first embodiment is omitted.

The toner production method according to the second embodiment includes a step of preparing the resin-bearing titanium oxide particles (also referred to below as Step 1) and a step of causing the resin-bearing titanium oxide particles to adhere to the surfaces of the toner mother particles (also referred to below as Step 2).

[Step 1]

In Step 1, the resin-bearing titanium oxide particles are prepared by mixing titanium oxide particles and resin particles under stirring using for example a mixer, and thus causing the resin particles to adhere to the surfaces of the titanium oxide particles. Through Step 1, for example, resin-bearing titanium oxide particles are obtained which include the titanium oxide particles and the resin particles adhering to the surfaces of the titanium oxide particles by Van der Waals force. Examples of mixers that can be used include a blender, a V-shaped mixer, a Q-type mixer, an FM mixer, a Loedige mixer, a multipurpose mixer, a super mixer, and HYBRIDIZATION SYSTEM (registered Japanese trademark).

[Step 2]

In Step 2, the toner mother particles and the resin-bearing titanium oxide particles obtained through Step 1 are mixed under stirring using for example a mixer, and thus the resin-bearing titanium oxide particles are caused to adhere to the surfaces of the toner mother particles. Through Step 2, for example, toner particles are obtained which include the toner mother particles and the resin-bearing titanium oxide particles adhering to the surfaces of the toner mother particles by Van der Waals force. Optional external additive particles (for example, silica particles) may be used in addition to the resin-bearing titanium oxide particles obtained through Step 1. The mixers that can be used in Step 1 can for example be also used in Step 2. The above-described method for example produces the toner including the toner particles 1 (see FIG. 1) described as the first embodiment. The toner production method according to the second embodiment can therefore produce a toner capable of inhibiting occurrence of an image defect due to whitening of a member while also inhibiting occurrence of image deletion.

<Third Embodiment: Image Forming Apparatus>

Figure 3:
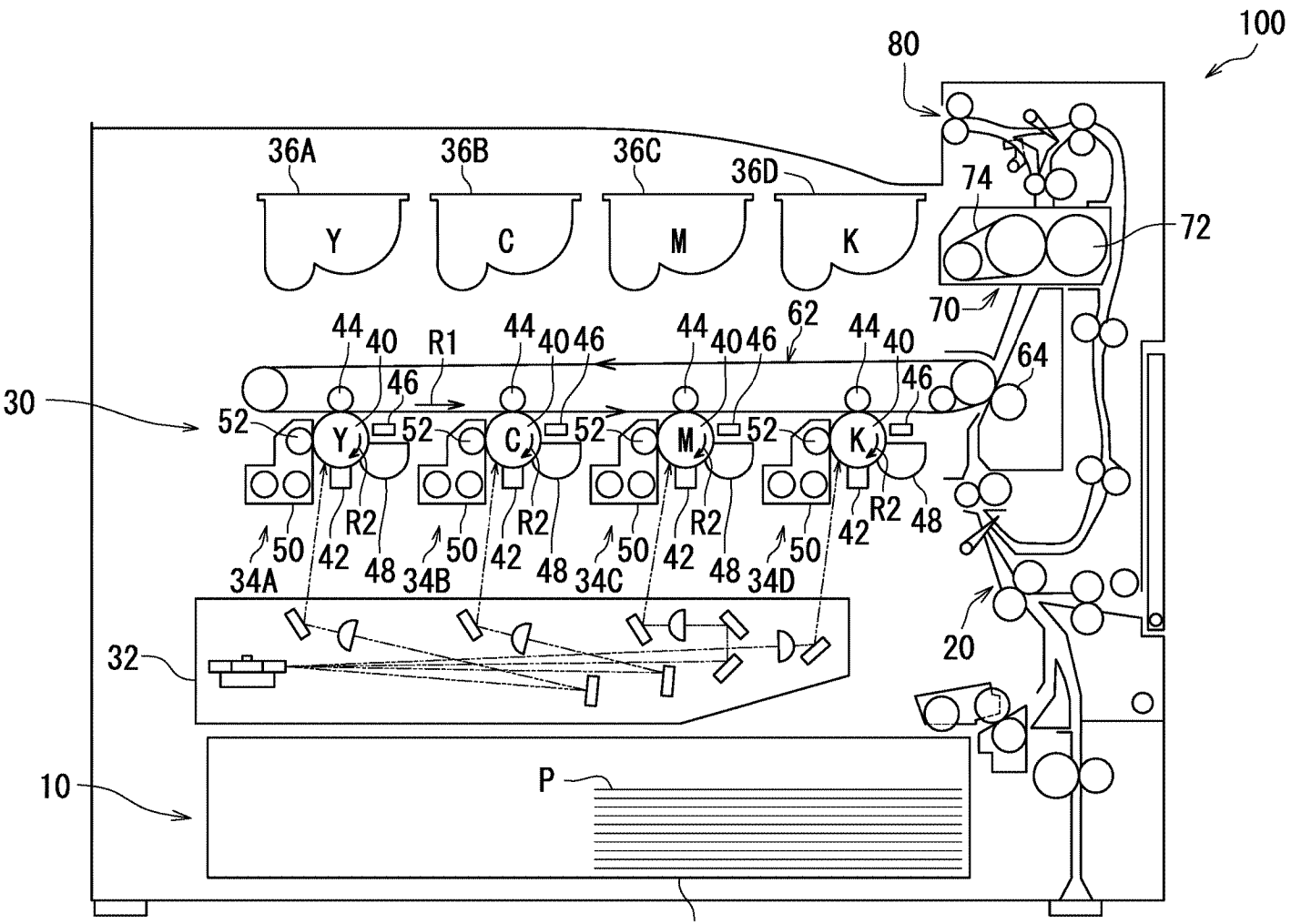
FIG. 3 is a diagram illustrating an example of a configuration of an image forming apparatus according to a third embodiment of the present disclosure.

The following describes an image forming apparatus according to a third embodiment of the present disclosure. FIG. 3 is a diagram illustrating a configuration of an image forming apparatus 100, which is an example of the image forming apparatus according to the third embodiment. The image forming apparatus 100 is a printer that forms an image on a sheet P, which is a recording medium. The image forming apparatus 100 includes a feed section 10, a conveyance section 20, an image forming section 30, and an ejection section 80.

The feed section 10 includes a cassette 11 for containing a plurality of the sheets P. The sheets P are for example paper or synthetic resin sheets. The feed section 10 feeds the sheets P to the conveyance section 20 one at a time. The conveyance section 20 conveys the sheet P to the image forming section 30. The image forming section 30 forms an image on the sheet P. After the image is formed on the sheet P, the conveyance section 20 conveys the sheet P to the ejection section 80. The ejection section 80 ejects the sheet P out of the image forming apparatus 100.

The image forming section 30 includes a light exposure unit 32, a first toner image generating unit 34A, a second toner image generating unit 34B, a third toner image generating unit 34C, a fourth toner image generating unit 34D, a first toner cartridge 36A, a second toner cartridge 36B, a third toner cartridge 36C, a fourth toner cartridge 36D, an intermediate transfer belt 62, a transfer device 64, and a fixing device 70. The image forming apparatus 100 according to the third embodiment is a tandem image forming apparatus, and the first to fourth toner image generating units 34A to 34D are in a linear arrangement.

Note that the first to fourth toner image generating units 34A to 34D are also referred to simply as toner image generating units 34A to 34D in the following description in order to avoid redundancy. Likewise, the first to fourth toner cartridges 36A to 36D are also referred to simply as toner cartridges 36A to 36D.

The light exposure unit 32 irradiates each of the toner image generating units 34A to 34D with light based on image data to form an electrostatic latent image for each of the toner image generating units 34A to 34D.

The toner image generating unit 34A forms a yellow toner image based on the electrostatic latent image. The toner image generating unit 34B forms a cyan toner image based on the electrostatic latent image. The toner image generating unit 34C forms a magenta toner image based on the electrostatic latent image. The toner image generating unit 34D forms a black toner image based on the electrostatic latent image.

The toner cartridge 36A contains a toner for forming yellow toner images. The toner cartridge 36B contains a toner for forming cyan toner images. The toner cartridge 36C contains a toner for forming magenta toner images. The toner cartridge 36D contains a toner for forming black toner images. The toners contained in the toner cartridges 36A to 36D are each the toner according to the first embodiment described above.

The intermediate transfer belt 62 circulates in a direction indicated by arrow R1. The toner images of the four colors are transferred (primary transfer) from the respective toner image generating units 34A to 34D onto an outer surface of the intermediate transfer belt 62 in order. The transfer device 64 is a transfer roller and transfers (secondary transfer) the toner images on the outer surface of the intermediate transfer belt 62 to the sheet P. The fixing device 70 applies heat and pressure to the sheet P to fix the toner images to the sheet P.

Each of the toner image generating units 34A to 34D includes a photosensitive drum 40 (image bearing member), a charger 42, a developing device 50, a primary transfer roller 44, a static elimination device 46, and a cleaner 48. In each of the toner image generating units 34A to 34D, the charger 42, the developing device 50, the primary transfer roller 44, the static elimination device 46, and the cleaner 48 are arranged in the stated order along a peripheral surface of the photosensitive drum 40.

The photosensitive drums 40 of the toner image generating units 34A to 34D are arranged in the direction indicated by arrow R1, which is a circulation direction of the intermediate transfer belt 62, so as to be in contact with the outer surface of the intermediate transfer belt 62. The primary transfer rollers 44 are disposed opposite to the photosensitive drums 40 in one-to-one correspondence, with the intermediate transfer belt 62 therebetween.

Each photosensitive drum 40 rotates in a direction indicated by arrow R2. Each charger 42 charges a peripheral surface of a corresponding one of the photosensitive drums 40. The light exposure unit 32 irradiates the peripheral surfaces of the photosensitive drums 40 with light to form electrostatic latent images.

No particular limitations are placed on the photosensitive drums 40, and photosensitive members each including an amorphous silicon-containing photosensitive layer in a surface portion thereof (also referred to below as amorphous silicon photosensitive members) or photosensitive members each including an organic photoconductive material-containing photosensitive layer in a surface portion thereof can for example be used.

Each developing device 50 for example includes a two-component developer containing a toner and a carrier. The developing devices 50 in the toner image generating units 34A to 34D are respectively connected to the toner cartridges 36A to 36D. Each of the toner cartridges 36A to 36D supplies the toner to the corresponding developing device 50. The carrier may be contained only in the developing devices 50 or may be contained both in the toner cartridges 36A to 36D and in the developing devices 50. In the latter case, each of the toner cartridges 36A to 36D may supply both the toner and the carrier to the corresponding developing device 50.

Each developing device 50 includes a development roller 52. The development roller 52 for example carries a two-component developer containing a toner and a carrier. Thus, the development roller 52 functions as a developer bearing member. Each development roller 52 supplies the toner from the developer carried thereon to the corresponding photosensitive drum 40. Each developing device 50 develops an electrostatic latent image on the corresponding photosensitive drum 40 by causing the toner to adhere to the electrostatic latent image to form a toner image on the peripheral surface of the photosensitive drum 40.

The primary transfer rollers 44 transfer the toner images carried on the respective photosensitive drums 40 to the outer surface of the intermediate transfer belt 62. After the toner images are transferred to the intermediate transfer belt 62, each static elimination device 46 eliminates static electricity from the peripheral surface of the corresponding photosensitive drum 40. Each cleaner 48 removes developer remaining on the peripheral surface of the corresponding photosensitive drum 40. At the same time, for example, the resin-bearing titanium oxide particles in the remaining developer scratch off a charging product adhering to the peripheral surface of the photosensitive drum 40.

As described above, image deletion easily occurs in a situation in which an amorphous silicon photosensitive member is used, because a surface of a photosensitive layer thereof is relatively highly hydrophilic, and thus a charging product easily adheres to the surface of the photosensitive layer. However, the image forming apparatus 100 can inhibit occurrence of image deletion even with the use of amorphous silicon photosensitive members, because the image forming apparatus 100 forms toner images using developers each containing the toner according to the first embodiment described above.

The toner images transferred to the outer surface of the intermediate transfer belt 62 are transferred to the sheet P by the transfer device 64. The sheet P with the toner images transferred thereto is conveyed to the fixing device 70 by the conveyance section 20. The fixing device 70 includes a fixing belt 74 and a pressing roller 72 that presses the toner images transferred to the sheet P. A roller having a fluororesin surface layer can for example be used as the pressing roller 72 of the fixing device 70. The sheet P is subjected to heat and pressure between the pressing roller 72 and the fixing belt 74 after having been conveyed to the fixing device 70. Through the above, the toner images (an image) are fixed to the sheet P. Thereafter, the sheet P is ejected out of the image forming apparatus 100 by the ejection section 80. As described above, the image forming apparatus 100 forms the image on the sheet P.

The image forming apparatus 100 can inhibit occurrence of an image defect due to whitening of a member such as the pressing roller 72 while also inhibiting occurrence of image deletion, because the image forming apparatus 100 forms toner images using developers each containing the toner according to the first embodiment described above.

Through the above, an example of the image forming apparatus according to the third embodiment has been described. However, the image forming apparatus according to the third embodiment is not limited to the image forming apparatus 100 described above. For example, the image forming apparatus according to the third embodiment may be a monochrome image forming apparatus. In such a situation, for example, it is only necessary that the image forming apparatus includes one toner image generating unit and at least one toner cartridge. Furthermore, the image forming apparatus according to the third embodiment may adopt a direct transfer process. In a situation in which the image forming apparatus according to the third embodiment adopts a direct transfer process, the transfer device directly transfers toner images on the photosensitive drums (image bearing members) to a recording medium.

EXAMPLES

The following describes Examples of the present disclosure. The following first describes preparation methods of toner mother particles A, which were used for production of non-capsule toner particles, and toner mother particles B, which were used for production of capsule toner particles.

<Preparation of Toner Mother Particles A>

[Synthesis of Non-crystalline Polyester Resin A1]

A four-necked flask having a capacity of 5 L and equipped with a thermometer (thermocouple), a drainage tube, a nitrogen inlet tube, and a stirrer was charged with 1,700 g of bisphenol A propylene oxide adduct ("BA-P2", product of NIPPON NYUKAZAI CO., LTD.), 650 g of bisphenol A ethylene oxide adduct ("BA-3U", product of NIPPON NYUKAZAI CO., LTD.), 500 g of n-dodecenyl succinic anhydride, 400 g of terephthalic acid, and 4 g of dibutyl tin oxide. The flask contents were then caused to react at 220° C. for 9 hours. Subsequently, the flask contents were caused to react in a reduced pressure atmosphere (pressure 8 kPa) at 220° C. for 1 hour to yield a non-crystalline polyester resin A1. The non-crystalline polyester resin A1 had a softening point (Tm) of 124.8° C., a glass transition point (Tg) of 57.2° C., an acid value of 6 mgKOH/g, a hydroxyl value of 41 mgKOH/g, a weight average molecular weight (Mw) of 109,475, and a number average molecular weight (Mn) of 3,737.

[Synthesis of Crystalline Polyester Resin A2]

A four-necked flask having a capacity of 5 L and equipped with a thermometer (thermocouple), a drainage tube, a nitrogen inlet tube, and a stirrer was charged with 990 g of 1,4-butanediol, 242 g of 1,6-hexanediol, 2.5 g of 1,4-benzenediol, and 1,480 g of fumaric acid. The flask contents were then caused to react at 170° C. for 5 hours. Subsequently, the flask contents were caused to react at 210° C. for 1.5 hours. Subsequently, the flask contents were caused to react in a reduced pressure atmosphere (pressure 8 kPa) at 210° C. for 1 hour. Subsequently, a standard ambient pressure atmosphere was regained, and 69 g of styrene and 54 g of n-butyl methacrylate were added into the flask. Subsequently, the flask contents were caused to react at 210° C. for 1.5 hours. Subsequently, the flask contents were caused to react in a reduced pressure atmosphere (pressure 8 kPa) at 210° C. for 1 hour. As a result, a crystalline polyester resin A2 was obtained. The crystalline polyester resin A2 had a softening point (Tm) of 88.8° C., a melting point (Mp) of 82° C., an acid value of 3.1 mgKOH/g, a hydroxyl value of 19 mgKOH/g, a weight average molecular weight (Mw) of 27,500, and a number average molecular weight (Mn) of 3,620.

[Mixing Process and Pulverization Process]

An FM mixer ("FM-20B", product of Nippon Coke & Engineering Co., Ltd.) was used to mix 90 parts by mass of the non-crystalline polyester resin A1, 10 parts by mass of the crystalline polyester resin A2, 3 parts by mass of a releasing agent (ester wax: "NISSAN ELECTOR (registered Japanese trademark) WEP-8", product of NOF Corporation), 1 part by mass of a positively chargeable charge control agent (quaternary ammonium salt: "BONTRON (registered Japanese trademark) P-51", product of ORIENT CHEMICAL INDUSTRIES, Co., Ltd.), and 6 parts by mass of carbon black ("MA-100", product of Mitsubishi Chemical Corporation). Subsequently, the resultant mixture was melt-kneaded using a twin screw extruder ("PCM-30", product of Ikegai Corp.) under conditions of a material feeding speed of 6 kg/hour, a shaft rotational speed of 160 rpm, and a cylinder temperature of 120° C. Thereafter, the resultant kneaded product was cooled. After cooling, the kneaded product was coarsely pulverized using a pulverizer ("ROTOPLEX (registered Japanese trademark)", product of Hosokawa Micron Corporation). Subsequently, the resultant coarsely pulverized product was finely pulverized using a pulverizer ("Turbo Mill model RS", product of FREUND-TURBO CORPORATION). Subsequently, the resultant finely pulverized product was classified using a classifier ("Elbow Jet model EJ-LABO", product of Nittetsu Mining Co., Ltd.). As a result, the toner mother particles A having a volume median diameter ($D_{50}$) of 7 μm were obtained.

<Preparation of Toner Mother Particles B>

[Preparation of Toner Cores B1]

An FM mixer ("FM-20B", product of Nippon Coke & Engineering Co., Ltd.) was used to mix 80 parts by mass of the non-crystalline polyester resin A1, 20 parts by mass of the crystalline polyester resin A2, 3 parts by mass of a releasing agent (ester wax: "NISSAN ELECTOR (registered Japanese trademark) WEP-8", product of NOF Corporation), and 6 parts by mass of carbon black ("MA-100", product of Mitsubishi Chemical Corporation). Subsequently, the resultant mixture was melt-kneaded using a twin screw extruder ("PCM-30", product of Ikegai Corp.) under conditions of a material feeding speed of 6 kg/hour, a shaft rotational speed of 160 rpm, and a cylinder temperature of 120° C. Thereafter, the resultant kneaded product was cooled. After cooling, the kneaded product was coarsely pulverized using a pulverizer ("ROTOPLEX" (registered Japanese trademark)" product of Hosokawa Micron Corporation). Subsequently, the resultant coarsely pulverized product was finely pulverized using a pulverizer ("Turbo Mill model RS", product of FREUND-TURBO CORPORATION). Subsequently, the resultant finely pulverized product was classified using a classifier ("Elbow Jet model EJ-LABO", product of Nittetsu Mining Co., Ltd.). As a result, toner cores B1 having a volume median diameter ($D_{50}$) of 7 μm were obtained.

[Preparation of Shell Material B2]

A three-necked flask having a capacity of 1 L and equipped with a thermometer and a stirring impeller was charged with 875 mL of ion exchanged water and 75 mL of an anionic surfactant (sodium polyoxyethylene alkyl ether sulfate: "LATEMUL (registered Japanese trademark) WX", product of Kao Corporation). Next, the internal temperature of the flask was raised up to 80° C. using a water bath, and subsequently two liquids (a first liquid and a second liquid) were dripped into the flask over 5 hours. The first liquid was a mixture of 18 mL of styrene and 2 mL of n-butyl acrylate. The second liquid was a solution of 0.5 g of potassium peroxodisulfate in 30 mL of ion exchanged water. Subsequently, the internal temperature of the flask was maintained at 80° C. for 2 hours to cause polymerization of the flask contents. As a result, a shell material B2, which was a suspension of a hydrophobic resin, was obtained. Fine resin particles contained in the thus obtained shell material B2 had a number average particle diameter of 32 nm and a glass transition point (Tg) of 71° C.

[Preparation of Shell Material B3]

A three-necked flask having a capacity of 1 L and equipped with a thermometer, a cooling tube, a nitrogen inlet tube, and a stirring impeller was charged with 90 g of isobutanol, 100 g of methyl methacrylate, 35 g of n-butyl acrylate, 30 g of 2-(methacryloyloxy)ethyl trimethylammonium chloride (product of Alfa Aesar), and 6 g of a polymerization initiator (2,2'-azobis[2-methyl-N-(2-hydroxyethyl) propionamide]: "VA-086", product of Wako Pure Chemical Industries, Ltd.), and the flask contents were caused to react in a nitrogen atmosphere at 80° C. for 3 hours. Next, another 3 g of the polymerization initiator was added into the flask, and the flask contents were caused to react in a nitrogen atmosphere at 80° C. for 3 hours to yield a polymer solution. The polymer solution was dried at 150° C. under reduced pressure and subjected to deagglomeration to yield a positively chargeable resin. Next, 200 g of the positively chargeable resin and 184 mL of ethyl acetate (JIS special grade, product of Wako Pure Chemical Industries, Ltd.) were loaded in a kneader ("HIVIS MIX (registered Japanese trademark) Model 2P-1" product of PRIMIX Corporation) and stirred at a rotational speed of 20 rpm for 1 hour to give a solution having high viscosity. To this solution, 18 mL of 1 N hydrochloric acid, 20 g of an anionic surfactant ("EMAL (registered Japanese trademark) 0", product of Kao Corporation), and an aqueous solution of 16 g of ethyl acetate in 562 g of ion exchanged water were added to yield a shell material B3, which was a suspension of the positively chargeable resin. Fine resin particles contained in the resultant shell material B3 had a number average particle diameter of 35 nm and a glass transition point (Tg) of 80° C.

[Shell Layer Formation Process]

A three-necked flask having a capacity of 1 L and equipped with a thermometer and a stirring impeller was charged with 100 mL of ion exchanged water, and then the internal temperature of the flask was maintained at 30° C. using a water bath. Next, the aqueous medium in the flask was adjusted to pH 4 through addition of dilute hydrochloric acid to the flask. Thereafter, into the flask, 0.35 mL of an aqueous methylol melamine solution ("MIRBANE (registered Japanese trademark) RESIN SM-607", product of Showa Denko K. K., solid concentration 80% by mass), 220 mL of the shell material B2, and 1.2 mL of the shell material B3 were added as shell layer raw materials, and then 300 g of the toner cores B1 were further added. The flask contents were stirred at a rotational speed of 200 rpm for 1 hour. Next, 300 mL of ion exchanged water was added into the flask, and then the internal temperature of the flask was raised up to 70° C. at a heating rate of 1° C./minute while the flask contents were stirred at a rotational speed of 100 rpm. Thereafter, the internal temperature of the flask was maintained at 70° C., and the flask contents were stirred at a rotational speed of 100 rpm for 2 hours. Thereafter, the flask contents were adjusted to pH 7 through addition of sodium hydroxide to the flask. Next, the flask contents were cooled to standard temperature (approximately 25° C.) to yield a dispersion containing the toner mother particles B.

[Washing Process]

The resultant dispersion of the toner mother particles B was filtered (solid-liquid separation) using a Buchner funnel to collect a wet cake of the toner mother particles B. The wet cake of the toner mother particles B was re-dispersed in ion exchanged water, and then filtered using a Buchner funnel. Furthermore, re-dispersing and filtering were repeated five times thereby to wash the toner mother particles B.

[Drying Process]

Next, the wet cake of the toner mother particles B was dispersed in a 50° % by mass aqueous ethanol solution. Through the above, a slurry of the toner mother particles B was obtained. Subsequently, the slurry of the toner mother particles B was dried using a continuous type surface modifier ("COATMIZER" (registered Japanese trademark)", product of Freund Corporation) under conditions of a hot air flow temperature of 45° C. and a flow rate of 2 $m^3$/minute. As a result, a powder of the toner mother particles B was obtained. The surface of the powder of the toner mother particles B was observed using a scanning electron microscope ("JSM-7401", product of JEOL Ltd.) to find that the surface was grainy from the fine resin particles but the fine resin particles were not in the form of individual, discrete particles.

Examples 1-9 and Comparative Examples 1-2

The following describes a method for producing toners according to Examples 1 to 9, and Comparative Examples 1 and 2.

Example 1

Production of Toner T1

(Preparation of Resin Particles)

A three-necked flask having a capacity of 2 L and equipped with a thermometer and a stirring impeller was charged with 900 mL of ion exchanged water, and then the internal temperature of the flask was raised up to 70° C. using a water bath. Thereafter, a liquid mixture of 90 mL (0.78 mol) of styrene and 10 mL (0.04 mol) of divinylbenzene ("328-24472", product of Wako Pure Chemical Industries, Ltd.) was added into the flask, and a solution of 0.1 g of potassium peroxodisulfate in 30 mL of ion exchanged water was further added into the flask. Subsequently, the internal temperature of the flask was maintained at 70° C. to cause the flask contents to react for 8 hours. After the reaction, the reaction liquid was subjected to centrifugation to collect a solid. The resultant solid was dried and subjected to deagglomeration to yield a powder of resin particles having a number average particle diameter of 83 nm.

(Preparation of Resin-bearing Titanium Oxide Particles)

Into a pulverization blender ("7011HS", product of SOGO LABORATORY GLASS WORKS CO., LTD), 90 g of conductive titanium oxide particles ("EC-210", product of Titan Kogyo, Ltd., volume median diameter ($D_{50}$): 0.5 μm) and 10 g of the above-described resin particles were added and stirred at a rotational speed of 18,000 rpm for 5 minutes. As a result, resin-bearing titanium oxide particles C1 were obtained which included the conductive titanium oxide particles and the resin particles adhering to surfaces of the conductive titanium oxide particles (more specifically, surface of each conductive layer).

(External Additive Addition Process)

An FM mixer ("FM-10B", product of Nippon Coke & Engineering Co., Ltd.) was used to mix 100 parts by mass of the toner mother particles A, 1.2 parts by mass of hydrophobic silica particles ("RA-200H", product of Nippon Aerosil Co., Ltd.), and 1.0 part by mass of the resin-bearing titanium oxide particles C1 for 2 minutes under conditions of a rotational speed of 3,000 rpm and a jacket temperature of 20'C. As a result, a toner T1 including a number of toner particles was obtained. The toner T1 was observed using a scanning electron microscope ("JSM-7401", product of JEOL Ltd.) to confirm that the surfaces of the toner mother particles A had the resin-bearing titanium oxide particles C1 adhering thereto. It was confirmed that the resin-bearing titanium oxide particles C1 included the titanium oxide particles, using an energy dispersive X-ray fluorescence spectrometer (product of JEOL Ltd.) attached to the scanning electron microscope.

Example 2

Production of Toner T2

A toner T2 was produced according to the same method as in Example 1 in all aspects other than that the toner mother particles B were used instead of the toner mother particles A in the external additive addition process. The toner T2 was observed using a scanning electron microscope ("JSM-7401", product of JEOL Ltd.) to confirm that the surfaces of the toner mother particles B had the resin-bearing titanium oxide particles adhering thereto.

Example 3

Production of Toner T3

A toner T3 was produced according to the same method as in Example 1 in all aspects other than that the amount of the conductive titanium oxide particles was changed to 99 g and the amount of the resin particles was changed to 1 g in the preparation of resin-bearing titanium oxide particles. The toner T3 was observed using a scanning electron microscope ("JSM-7401", product of JEOL Ltd.) to confirm that the surfaces of the toner mother particles A had the resin-bearing titanium oxide particles adhering thereto.

Example 4

Production of Toner T4

A toner T4 was produced according to the same method as in Example 1 in all aspects other than that the amount of the conductive titanium oxide particles was changed to 99.5 g and the amount of the resin particles was changed to 0.5 g in the preparation of resin-bearing titanium oxide particles. The toner T4 was observed using a scanning electron microscope ("JSM-7401", product of JEOL Ltd.) to confirm that the surfaces of the toner mother particles A had the resin-bearing titanium oxide particles adhering thereto.

Example 5

Production of Toner T5

A toner T5 was produced according to the same method as in Example 1 in all aspects other than that the amount of the conductive titanium oxide particles was changed to 50 g and the amount of the resin particles was changed to 50 g in the preparation of resin-bearing titanium oxide particles. The toner T5 was observed using a scanning electron microscope ("JSM-7401", product of JEOL Ltd.) to confirm that the surfaces of the toner mother particles A had the resin-bearing titanium oxide particles adhering thereto.

Example 6

Production of Toner T6

A toner T6 was produced according to the same method as in Example 1 in all aspects other than that the amount of the conductive titanium oxide particles was changed to 40 g and the amount of the resin particles was changed to 60 g in the preparation of resin-bearing titanium oxide particles. The toner T6 was observed using a scanning electron microscope ("JSM-7401", product of JEOL Ltd.) to confirm that the surfaces of the toner mother particles A had the resin-bearing titanium oxide particles adhering thereto.

Example 7

Production of Toner T7

A toner T7 was produced according to the same method as in Example 1 in all aspects other than that the amount of the styrene was changed to 80 mL and the amount of the divinylbenzene was changed to 20 mL in the preparation of resin particles. The toner T7 was observed using a scanning electron microscope ("JSM-7401", product of JEOL Ltd.) to confirm that the surfaces of the toner mother particles A had the resin-bearing titanium oxide particles adhering thereto. The resin particles of the toner T7 had a number average particle diameter of 80 nm.

Example 8

Production of Toner T8

A toner T8 was produced according to the same method as in Example 1 in all aspects other than that the amount of the styrene was changed to 50 mL and the amount of the divinylbenzene was changed to 50 mL in the preparation of resin particles. The toner T8 was observed using a scanning electron microscope ("JSM-7401", product of JEOL Ltd.) to confirm that the surfaces of the toner mother particles A had the resin-bearing titanium oxide particles adhering thereto. The resin particles of the toner T8 had a number average particle diameter of 90 nm.

Example 9

Production of Toner T9

A toner T9 was produced according to the same method as in Example 1 in all aspects other than that no divinylbenzene was used and only 100 mL of styrene was used as a monomer in the preparation of resin particles. The toner T9 was observed using a scanning electron microscope ("JSM-7401", product of JEOL Ltd.) to confirm that the surfaces of the toner mother particles A had the resin-bearing titanium oxide particles adhering thereto. The resin particles of the toner T9 had a number average particle diameter of 83 nm.

Comparative Example 1

Production of Toner T11

An FM mixer ("FM-10B", product of Nippon Coke & Engineering Co., Ltd.) was used to mix 100 parts by mass of the toner mother particles A, 1.2 parts by mass of hydrophobic silica particles ("RA-200H", product of Nippon Aerosil Co., Ltd.), and 0.9 parts by mass of conductive titanium oxide particles ("EC-210", product of Titan Kogyo, Ltd., volume median diameter ($D_{50}$): 0.5 μm) for 2 minutes under conditions of a rotational speed of 3.000 rpm and a jacket temperature of 20° C. As a result, a toner T11 including a number of toner particles was obtained.

Comparative Example 2

Production of Toner T12

An FM mixer ("FM-10B", product of Nippon Coke & Engineering Co., Ltd.) was used to mix 100 parts by mass of the toner mother particles A and 1.2 parts by mass of hydrophobic silica particles ("RA-200H", product of Nippon Aerosil Co., Ltd.) for 2 minutes under conditions of a rotational speed of 3,000 rpm and a jacket temperature of 20'C. As a result, a toner T12 including a number of toner particles was obtained.

<Physical Properties of Toner>

[Roundness]

The roundness of the resin particles contained in the toners T1 to T9 was measured according to the method described below. With respect to each of the toners, a number of resin particles included in the toner were imaged using a transmission electron microscope ("JSM-6700F", product of JEOL Ltd.), and the resultant image (field size: 0.975 μm×1.200 μm) was analyzed using image analysis software ("WinROOF", product of Mitani Corporation). Specifically, 10 resin particles were randomly selected in the image, and a value for the roundness of each selected resin particle (perimeter of a circle having the same area as a projection of the resin particle/perimeter of the resin particle) was measured. A number average of the thus obtained values for the roundness of the 10 resin particles was calculated to be taken as a roundness of the resin particles included in the toner. Table 1 shows the result.

[Gel Fraction]

The gel fraction of the resin particles contained in the toners T1 to T9 was measured according to the method described below Each of the toners was classified using a classifier ("Elbow Jet model EJ-LABO", product of Nittetsu Mining Co.) to collect fine particles having a particle size of no greater than 2.0 μm. The collected fine particles were observed using a scanning electron microscope ("JSM-7401", product of JEOL Ltd.) to confirm separation of the external additive from the toner mother particles and inclusion of no toner mother particles. The fine particles in an amount of 0.5 g were dispersed in 10 mL of tetrahydrofuran (referred to below as THF), and subsequently subjected to centrifugation under conditions of an acceleration of 10,000 G and a centrifugation time of 30 minutes. As a result, four separate layers were obtained. The following describes the separate layers as a first layer, a second layer, a third layer, and a fourth layer from the top in the stated order. The first and second layers were separately collected and dried to obtain dried products. A gel fraction was determined from the mass of the dried products in accordance with the following formula Table 1 shows the result. The first to fourth layers were separately collected, dried, and analyzed by infrared spectroscopy and energy dispersive X-ray fluorescence spectroscopy to find that the first layer included a THF soluble component of the resin particles and the second layer included a THF insoluble component of the resin particles (mainly a cross-linking component of the resin particles). It was also found that the third layer included the silica particles and the fourth layer included the titanium oxide particles.

Gel fraction (%)={mass of dried product of second layer/(mass of dried product of first layer+mass of dried product of second layer)}×100

[Coverage Ratio]

With respect to each of the toners T1 to T9, a proportion of the area of a resin particle-covered region out of the surface of each resin-bearing titanium oxide particle included in the toner (coverage ratio) was determined according to the method described below. A scanning electron microscope ("JSM-7401", product of JEOL Ltd.) was used to take secondary and backscattered electron images of the same field (field size: 1.950 μm×2.400 μm) that each included a number of resin-bearing titanium oxide particles in the toner. Random 100 resin-bearing titanium oxide particles were selected within the images. With respect to each of the selected resin-bearing titanium oxide particles, an area S1 of the resin-bearing titanium oxide particle on the secondary electron image and an area S2 of a specific region of the resin-bearing titanium oxide particle were measured. The specific region was a region that was visible on the secondary electron image but not visible on the backscattered electron image. The areas S1 and S2 were measured using image analysis software ("WinROOF", product of Mitani Corporation). Next, a value for the coverage ratio of the resin-bearing titanium oxide particle was calculated in accordance with the following formula. A number average of the values for the coverage ratio of the 100 resin-bearing titanium oxide particles obtained as described above was then calculated. The thus obtained average was taken to be the proportion of the area of the resin particle-covered region out of the surface of each resin-bearing titanium oxide particle included in the toner (coverage ratio). Table 1 shows the result. Note that the specific region of each of the resin-bearing titanium oxide particles, which was visible on the secondary electron image but not visible on the backscattered electron image, corresponds to the resin particle-covered region out of the surface of the resin-bearing titanium oxide particle.

$$\text{Coverage ratio (\%)}=(S2/S1)\times 100$$

<Evaluation Methods>

Each of the toners T1 to T9, T11, and T12 was evaluated according to the evaluation methods described below by preparing an evaluation developer according to the preparation method described below and using an evaluation apparatus (monochrome multifunction peripheral "TASKALFA (registered Japanese trademark) 8001i", product of KYOCERA Document Solutions Inc.). The evaluation apparatus included an amorphous silicon photosensitive member as a photosensitive drum and a fixing device having a pressing roller.

[Preparation of Evaluation Developer]

With respect to each of the toners, a two-component developer was prepared by mixing 10 parts by mass of the toner and 100 parts by mass of a developer carrier (carrier for "TASKALFA (registered Japanese trademark) 8001i", product of KYOCERA Document Solutions Inc.) for 30 minutes using a ball mill.

[Evaluation 1: Evaluation Based on Image Deletion]

With respect to each of the toners, the toner as an evaluation toner was loaded in a toner cartridge of the evaluation apparatus, and the evaluation developer was loaded in a developing device of the evaluation apparatus. The evaluation apparatus was left to stand for 24 hours under environmental conditions of a temperature of 28° C. and a relative humidity of 80%. Thereafter, a halftone image (image density 25%) was printed on a sheet of printing paper to confirm presence or absence of image deletion. When image deletion was observed, drum refreshing described below was performed one to five times, and another halftone image (image density 25%) was printed on a sheet of printing paper to confirm presence or absence of image deletion. The printing result was rated based on the following rating standard. The rating results are shown in the column titled "Evaluation 1" of Table 1. In Evaluation 1 (evaluation based on image deletion), a toner having a printing result rated as A B, or C was evaluated as "good", and a toner having a printing result rated as D was evaluated as "poor".

(Rating Standard in Evaluation 1)

A: No image deletion was observed in the first printing.

B: Image deletion was observed in the first printing, but no image deletion was observed in the printing performed after the drum refreshing described below was performed once.

C: Image deletion was observed in the first printing, but no image deletion was observed in the printing performed after the drum refreshing described below was performed two to five times.

D: Image deletion was observed in the first printing, and image deletion was also observed in the printing performed after the drum refreshing described below was preformed five times.

(Drum Refreshing)

The drum refreshing was performed according to the method described below. First, a toner layer was formed on a development sleeve without feeding any paper. Subsequently, the photosensitive drum was irradiated with light to form an electrostatic latent image spanning the entire circumference of the photosensitive drum for a solid image. The toner was supplied from the toner layer to the photosensitive drum to form a toner image (toner image corresponding to a black solid image) spanning the entire circumference of the photosensitive drum. Next, the photosensitive drum was caused to rotate for 1 minute just for polishing the photosensitive drum with toner collected by a cleaner.

[Evaluation 2: Evaluation Based on Occurrence of Image Defect Due to Whitening of Pressing Roller]

With respect to each of the toners, the toner as an evaluation toner was loaded in a toner cartridge of the evaluation apparatus, and the evaluation developer was loaded in a developing device of the evaluation apparatus to print a text image having a coverage of 3% on 300,000 successive sheets of printing paper under environmental conditions of a temperature of 20° C. and a relative humidity of 60%. Occurrence of an image defect (staining and a line) due to whitening of the pressing roller was observed. The printing result was rated based on the following rating standard. The evaluation results are shown in the column titled "Evaluation 2" of Table 1. In Evaluation 2 (evaluation based on occurrence of an image defect due to whitening of the pressing roller), a toner having a printing result rated as A, B, C, or D was evaluated as "good", and a toner having a printing result rated as E was evaluated as "poor". Note that "staining" means dots or short lines that occur at random times due to toner adhering to whitened regions of the pressing roller. Also note that a "line" means a linear image defect formed as a result of dots of an image expanding because the amount of adhering toner increases due to charge accumulation in a significantly whitened region of the pressing roller. "Staining" is an image defect that is negligible in practical applications, whereas a "line" is an image defect that is significant in practical applications.

(Rating Standard in Evaluation 2)

A: No staining and no line occurred before completion of printing on the $300{,}000^{th}$ sheet.

B: No line occurred before completion of printing on the 300,000$^{th}$ sheet, but staining occurred between printing on the 180,000$^{th}$ sheet and printing on the 300,000$^{th}$ sheet.

C: No line occurred before completion of printing on the 300,000$^{th}$ sheet, but staining occurred between printing on the 120,000$^{th}$ sheet and printing on the 180,000$^{th}$ sheet.

D: No line occurred before completion of printing on the 300,000$^{th}$ sheet, but staining occurred before completion of printing on the 120,000$^{th}$ sheet.

E: A line occurred before completion of printing on the 300,000$^{th}$ sheet.

As evident from Table 1, the toners according to Examples 1 to 9 inhibited occurrence of an image defect due to whitening of the pressing roller better than the toner according to Comparative Example 1. The toners according to Examples 1 to 9 also inhibited occurrence of image deletion better than the toner according to Comparative Example 2.

TABLE 1

| | Toner | | | | | | | | |
|---|---|---|---|---|---|---|---|---|---|
| | | | | Resin particles | | | | Evaluation result | |
| | Type | Toner mother particles | Titanium oxide particles | Number average particle diameter (nm) | Roundness | Gel fraction (%) | Coverage ratio (%) | Evaluation 1 (Image deletion) | Evaluation 2 (Whitening) |
| Example 1 | T1 | Toner mother particles A | Conductive titanium oxide particles | 83 | 0.995 | 53 | 8 | A | A |
| Example 2 | T2 | Toner mother particles B | Conductive titanium oxide particles | 83 | 0.995 | 53 | 8 | A | A |
| Example 3 | T3 | Toner mother particles A | Conductive titanium oxide particles | 83 | 0.995 | 53 | 4 | A | B |
| Example 4 | T4 | Toner mother particles A | Conductive titanium oxide particles | 83 | 0.995 | 53 | 1 | A | C |
| Example 5 | T5 | Toner mother particles A | Conductive titanium oxide particles | 83 | 0.995 | 53 | 38 | B | A |
| Example 6 | T6 | Toner mother particles A | Conductive titanium oxide particles | 83 | 0.995 | 53 | 42 | C | A |
| Example 7 | T7 | Toner mother particles A | Conductive titanium oxide particles | 80 | 0.852 | 83 | 8 | A | A |
| Example 8 | T8 | Toner mother particles A | Conductive titanium oxide particles | 90 | 0.810 | 95 | 8 | A | D |
| Example 9 | T9 | Toner mother particles A | Conductive titanium oxide particles | 83 | 0.998 | 20 | 8 | A | D |
| Comparative Example 1 | T11 | Toner mother particles A | Conductive titanium oxide particles | None | | | | A | E |
| Comparative Example 2 | T12 | Toner mother particles A | None | None | | | | D | A |

Each of the toners T1 to T9 (toners according to Examples 1 to 9) included the toner mother particles A or B containing a binder resin and resin-bearing titanium oxide particles adhering to the surfaces of the toner mother particles A or B. The resin-bearing titanium oxide particles in each of the toners T1 to T9 included conductive titanium oxide particles and resin particles adhering to the surfaces of the conductive titanium oxide particles.

As shown in Table 1, Examples 1 to 9 were evaluated as A (good), B (good), or C (good) in Evaluation 1 (evaluation based on image deletion). Also, Examples 1 to 9 were evaluated as A (good), B (good), C (good), or D (good) in Evaluation 2 (evaluation based on occurrence of an image defect due to whitening of the pressing roller).

The toner T11 (toner according to Comparative Example 1) included conductive titanium oxide particles as external additive particles, but the conductive titanium oxide particles had no resin particles adhering thereto. The toner T12 (toner according to Comparative Example 2) included no titanium oxide particles.

As shown in Table 1, Comparative Example 1 was evaluated as E (poor) in Evaluation 2 (evaluation based on occurrence of an image defect due to whitening of the pressing roller). Comparative Example 2 was evaluated as D (poor) in Evaluation 1 (evaluation based on image deletion).

What is claimed is:

1. An electrostatic latent image developing toner comprising toner particles, wherein each of the toner particles includes:

a toner mother particle containing a binder resin; and an external additive including external additive particles adhering to a surface of the toner mother particle, and each of the external additive particles includes a titanium oxide particle and resin particles adhering to a surface of the titanium oxide particle.

2. The electrostatic latent image developing toner according to claim 1, wherein a proportion of an area of a resin particle-covered region out of a surface of the titanium oxide particle is at least 1% and no greater than 50%, the resin particle-covered region being covered with the resin particles.

3. The electrostatic latent image developing toner according to claim 1, wherein the resin particles have a roundness of at least 0.830.

4. The electrostatic latent image developing toner according to claim 1, wherein the resin particles adhere to the titanium oxide particle by Van der Waals force.

5. The electrostatic latent image developing toner according to claim 1, wherein a conductive layer covers at least a portion of the surface of the titanium oxide particle.

6. The electrostatic latent image developing toner according to claim 1, wherein the resin particles contain a radical polymer.

7. The electrostatic latent image developing toner according to claim 1, wherein the resin particles have a cross-linking structure.

8. The electrostatic latent image developing toner according to claim 7, wherein the resin particles have a gel fraction of at least 30% and no greater than 90%.

9. The electrostatic latent image developing toner according to claim 1, wherein the titanium oxide particles have a volume median diameter ($D_{50}$) of at least 0.1 μm and no greater than 1 μm, and the resin particles have a number average particle diameter of at least 50 nm and no greater than 500 nm.

* * * * *